United States Patent [19]

Dürslen et al.

[11] Patent Number: 4,532,010

[45] Date of Patent: Jul. 30, 1985

[54] DOOR STRUCTURE FOR COKING OVENS

[75] Inventors: Heinz Dürslen, Essen; Winifried Faust, Mühlheim; Rainer Schlösser, Essen, all of Fed. Rep. of Germany

[73] Assignee: Krupp-Koppers GmbH, Essen, Fed. Rep. of Germany

[21] Appl. No.: 586,097

[22] Filed: Mar. 5, 1984

[30] Foreign Application Priority Data

Mar. 5, 1983 [DE] Fed. Rep. of Germany ..... 3307844

[51] Int. Cl.[3] ..... C10B 25/06; C10B 25/24

[52] U.S. Cl. ..... 202/248; 110/173 R; 202/242

[58] Field of Search ..... 202/298, 242; 110/173 R, 173 B

[56] References Cited

U.S. PATENT DOCUMENTS 4,028,193 6/1977 Nagayoshi ..... 110/173 R

FOREIGN PATENT DOCUMENTS 536358 10/1931 Fed. Rep. of Germany ..... 202/248

2536291 2/1977 Fed. Rep. of Germany .

*Primary Examiner*—Peter Kratz

*Assistant Examiner*—Mike McGurk

*Attorney, Agent, or Firm*—Michael J. Striker

[57] ABSTRACT

A door structure for coke oven is disclosed which includes at least two locking head rails and having a door body which is continuously made of a flexible and elastic material. According to this invention, the material of the door body and the sealing membrane or its compression elements are dimensioned such that ratio of the rigidity of the door body to the specific contact pressure of the sealing membrane is so small that the thermal deformation of the body is compensated mainly by the combined locking forces exerted by the head rails and by the contact forces exerted by the sealing strip.

2 Claims, 6 Drawing Figures

DOOR STRUCTURE FOR COKING OVENS

BACKGROUND OF THE INVENTION

The present invention relates to a door structure for use in coke ovens, the structure being of the type having at least two locking head rails and a door body continuously made of a flexible and elastic material and being provided with a sealing membrane cooperating with compression elements which bias the sealing membrane against a door frame on the oven. In particular, the door structure of this invention is designed for operation with temperature gradients T of more than 100 K/m.

In the construction of modern coke oven installations, the trend is to design coke oven chambers which are larger in size in comparison with prior constructions and especially the height of the chambers tends to increase. While prior coke ovens were mainly built with chamber heights up to about 4 meters and chamber width up to about 450 mm, contemporary coke oven batteries have chambers up to 8 meters heigh and up to 600 mm wide, and these dimensioning has proved successful in operation. This development has contributed essentially for improving the economy of the coke production.

Due to the before described increased dimensions, an effective seal of the chambers in the region of the door structures is of particular importance in order to protect environment against pollution. Conventionally, the coke oven doors are pressed against door frames on the chambers by head rails, as a rule by two, but frequently by three locking head rails.

A large number of different door structures has been already developed and applied with a different degree of success. In general it can be stated that with increasing size of the openings of the coke oven chambers the construction and design of door structures which sealingly close the chambers during the entire coking process has become increasingly more difficult.

As known, the coke door structures has been equipped with most diversified forms of metal on metal sealing strips, such as angular membranes, Z-membranes, flat steel membranes, wedge-like sealing strips and the like. All these prior art sealing members, even if exhibiting over a certain range elastic quality and being assisted by pressure elements such as compression springs to insure proper contact with the door frame, must be readjusted from time to time depending on their dislocation or deformation caused by temperature differences acting on the chamber door frame and/or door bodies. This readjustment of flat or wedging membranes for example, is usually made by hammer blows, and in the case of elastic membranes the compression elements must be reset.

In practice it has been found that the before-mentioned prior art measures for sealing the doors are frequently insufficient especially for sealing chamber openings of large height and that frequently a contamination of the environment will result.

Depending on the construction of the coke oven, time intervals between 16 and 25 hours are required between the charging of a chamber with cold coal and the completion of the coking process. During this time period, both the chamber door frames and the door bodies are exposed to different temperature loads. The temperature loads produce again different temperature gradients in the door frames and door bodies which in turn cause different deformations during the coking period. Moreover, the deforming condition of the door frame and body is further influenced by ambient conditions, for example by heavy rain or large temperature variations. Also the exposure of the door frame to flame causes over prolongated time periods a change in the frame form.

Due to the temperature load the changed contour of the door body normally strongly deviates from the contour of the door frame and consequently over the entire height of the door a gap of variable width develops between the door body and the door frame. The width of the gap also changes with time.

The magnitude of the thermal deformation of the chamber door frames and the door bodies increases quadratically with the height of the chamber and consequently the gap between the frame and the door body changes in the same extent in width. It is evident therefore the problems encountered with sealing of the door structure become substantially aggravated with the increased height of the oven chamber.

Contemporary embodiments of door bodies, due to thermal loads are subject to considerable thermal deformations which at doors of a height of about 8 meters may amount to about 25 mm. In such door bodies which are usually made of heavy duty U-steel sections with web faces of a height of more than 250 mm, a counter-deformation by available locking forces exerted by the head rail is possible only to an extremely limited extent. The provision of mostly spring-loaded sealing membranes has the purpose of covering relatively large gaps between the door body and the door frame particularly in the top range, intermediate range and the bottom range of the door. In order to obtain the requisite bending elasticity, the membranes are normally made of metal sheets of minute thickness of maximum of 1.5 mm. The sealing sheet metals of such a small thickness however are hardly suitable for withstanding rough operational conditions of a coke oven and for withstanding the attack of mechanical cleaning tools. For this reason, the sealing means require considerable maintenance and cause dead times.

Compression springs acting on the sealing membranes must have a characteristic line which insures that at relatively long course or pitch of the spring sufficient compression force is still available in order to compensate for retroactive forces resulting from the flexture of the membrane; moreover the compression spring must exhibit sufficiently large contact pressure with specific sealing force q between a sealing edge and the chamber door frame at all operational conditions of the oven. This contact pressure should not fall below a certain minimum value during the entire coking time. This requirement, however, has not been met with conventional door structures.

In order to diminish the aforementioned difficulties it has been already devised to equip the door structures with door bodies having flexible and elastic quality. For example, in the German publication DE-PS No. 2,536,291 it has been proposed that above and below the door locking devices (head rails), the metal door body be provided with recesses which reduce the resistance and thus enable the fracture of the door body in its top and bottom regions. This measure, however, fell below expectation in the case of high oven structures.

SUMMARY OF THE INVENTION

It is, therefore, a general object of the present invention to overcome the aforementioned disadvantages.

More particularly, it is an object of the invention to provide an improved door structure for coke ovens which is not possessed of these disadvantages.

In keeping with this object and others which will become apparent hereafter, one feature of the invention resides, in a door structure of the beforedescribed type, in the provision of a door body having a rigidity (ExI) and a sealing membrane exerting a contact pressure (q) such that the ratio of the rigidity of the door body to the contact pressure of the sealing membrane is so small that thermal deformation of the door body is predominantly compensated for by the locking forces produced by the two head rails, and by the contact force of the sealing membrane.

It has been found that the above condition is fulfilled when the parameters of the door structure conform to the following formula:

$$\frac{E \cdot I}{q} \leqq \frac{\alpha \cdot H^2 \left(2 + \frac{2 \cdot B}{L}\right)}{2.06 \cdot 10^{-7} \mathrm{mm}^{-1}}$$

where $$\alpha = \frac{5}{384} \cdot \frac{1 - 4.8 \cdot \frac{f^2}{H^2}}{1 + 2 \cdot \frac{f}{H}}$$

wherein E is the elasticity module of the material of the door body, I is the angular moment of the door body, q is the sealing contact force between the edge of the sealing membrane and the chamber door frame per a length unit, H is the distance between the upper and lower head rail, f is the distance between the upper or lower head rail and the upper or lower edge of the door body, L is the total length of the door structure, and B is the length of the sealing edge over the width of the door structure.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
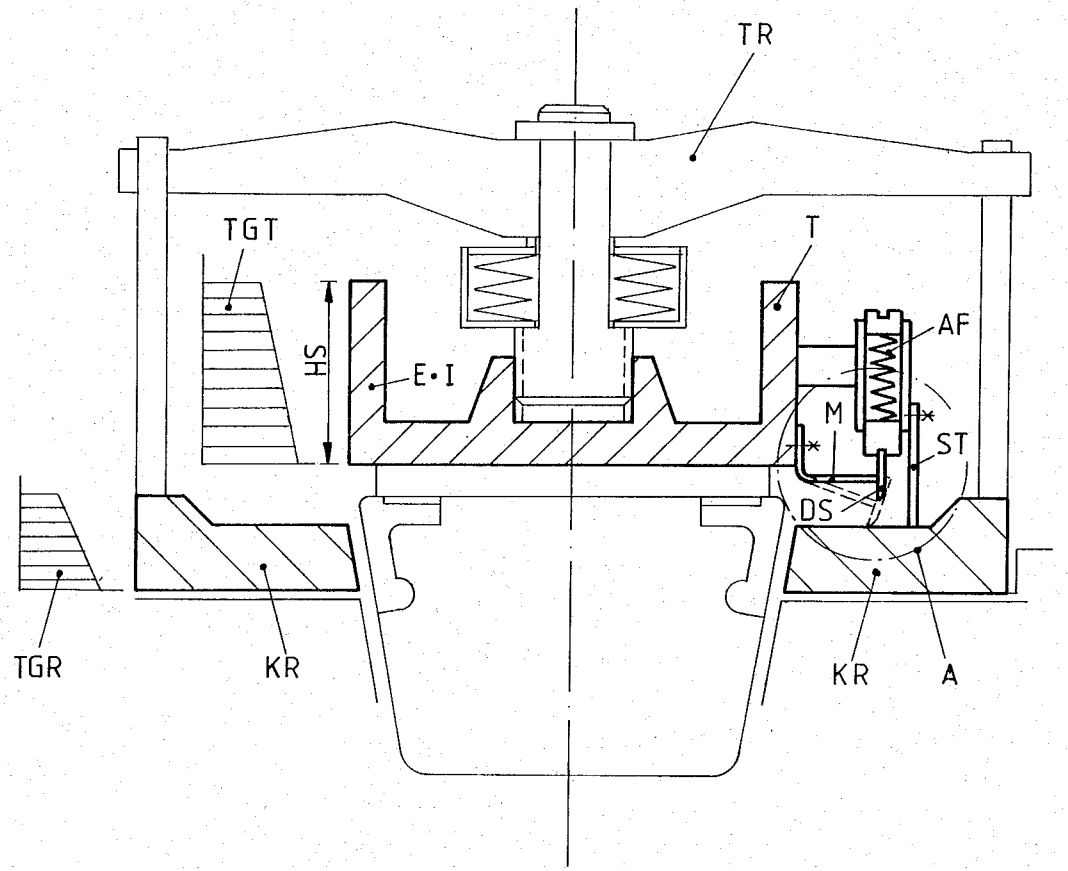
FIG. 1 is a sectional top view of an example of a door structure for coke ovens.

FIG. 1 illustrates an exemplary embodiment of a door structure according to this invention. A door body T is designed such as to possess a small moment of inertia I and consequently, a bending rigidity which meets the conditions of the before discussed deformation formula EXI/q.

Figure 2:
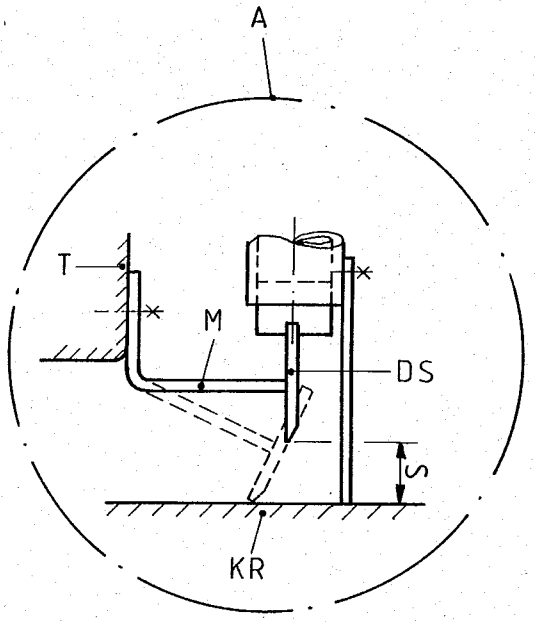
FIG. 2 is a cut-away view of a detail of FIG. 1.

For the sake of simplicity of the representation of deformations to be compensated, it is assumed that the chamber door frame KR against which the door body T abuts, remains in a straight plane. In reality however the chamber frame KR is also subject to thermal deformations due to the temperature gradients TGR in the frame, as indicated in FIG. 1. By a suitable anchoring system such deformation in the frame can be prevented by forcibly keeping the anchoring load on the chamber door frame against the prime surface of the brickwork. It will be seen from FIGS. 1 and 2, the door structure includes locking head rail TR imparting a locking force to the door body T against the chamber door frame KR. The door body supports compressing elements AF which exert sealing pressure against an elastic membrane M secured to a peripheral portion of the door body and being provided with a sealing strip DS acted upon by the compressing elements. The door body during the locking process is exposed to a temperature gradient TGT schematically indicated in FIG. 1.

Figure 3:
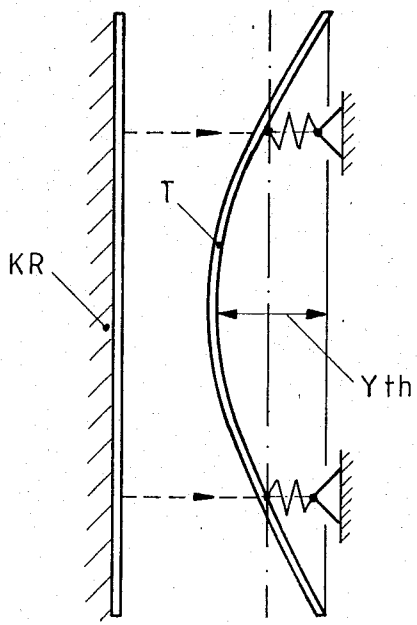
FIG. 3 illustrates schematically in exaggerated form the deformation of the door body due to temperature load.

In closed condition of the door during the operation of the coke oven, the door body T resting on the chamber door frame KR becomes deformed due to the temperature gradient TGT across the door body as well as due to thermal expansion coefficient of the material of the door body amounting from 0.9 to $2\times10^{-5}$ $K^{-1}$. The deflections in the center of the door body resulting from this deformation is indicated by reference character $Y_{th}$ in FIG. 3.

Figure 4:
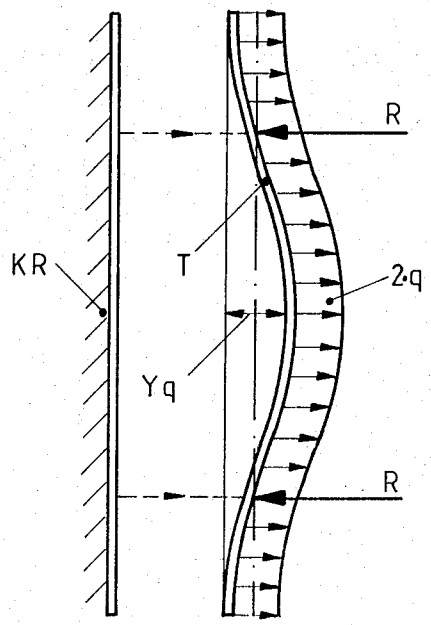
FIG. 4 shows the deformation of the door body due to the locking force applied by head rails and due to contact force applied by the sealing strip.

Simultaneously, the door body is subject to additional deformation indicated in exaggerated form in FIG. 4, resulting from the locking forces R exerted by the head rail, and from the specific contact forces q exerted by the sealing strips DS.

Figure 5:
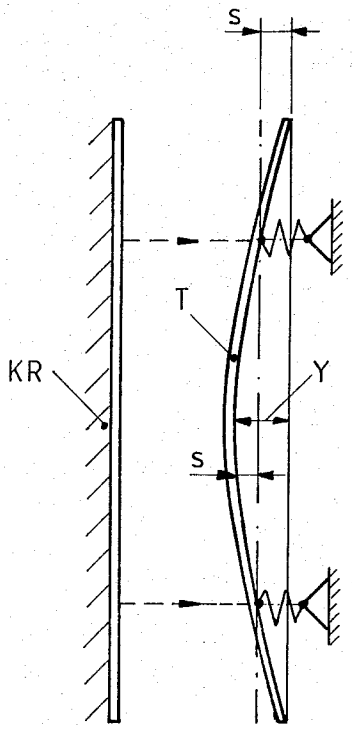
FIG. 5 illustrates the deformation of the door body due to combined temperature load, locking force of the head rails and contact force of the sealing strip.

The resulting bending deformation in the center of the door is indicated by $Y_q$. In practice, both deforming loads occur simultaneously and a superposition $Y_{th}-Y_q=Y$ will result as indicated in FIG. 5.

A substantial deformation $Y_q$ due to the specific contact force q exerted by the sealing strips which in general are predetermined by the specific design, is attainable only then when the bending rigidity ExI of the door body T is so small that the condition expressed by the above mentioned deformation formula is fulfilled.

The above considerations relate, as mentioned before, to a coke oven door structure having two locking head rails and a planar chamber door frame. In actual operation, however, it cannot be excluded that also the door frame exhibits a certain thermal deformation. In this case it is advantageous to provide a third locking head rail in the middle of the door body.

Figure 6:
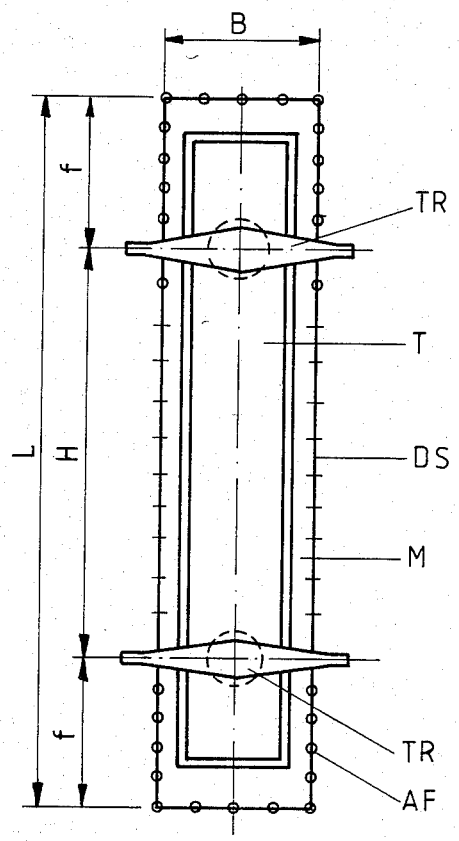
FIG. 6 is a schematic elevation view of the door structure of this invention.

The following table gives exemplary results obtained according to the abovementioned formula for doors of a height between six to 10 meters. In determining these values the distance f between the upper or lower head rail and the corresponding end of the door is preset to about 1 meter, and that the length B of the sealing strip over the width of the door is about 500 mm. The distance H between the head rails pertaining to a given door length L (FIG. 6) is determined from the formula $H=2f$.

| door length L in mm | $\frac{E \cdot I}{q}$ in $mm^3$ |
|---|---|
| 6000 | $1{,}02 \cdot 10^{12}$ |
| 7000 | $1{,}95 \cdot 10^{12}$ |
| 7500 | $2{,}52 \cdot 10^{12}$ |
| 8000 | $3{,}14 \cdot 10^{12}$ |
| 9000 | $4{,}59 \cdot 10^{12}$ |
| 10000 | $6{,}29 \cdot 10^{12}$ |

The ratio ExI/q in conventional cast iron door structures of a total length of about 7.30 meters amounts from $4.5 \times 10^{12}$ to $5.0\ 10^{12}$ $mm^3$.

In comparison with the ratio values according to this invention shown for example for the door length 7.5 meters in the above table, it is evident that the bending rigidity of the door according to this invention substantially differs from that of conventional door structures.

By means of this invention it is achieved that the gap between the door body and the door frame due to the superposition of the forces as indicated in FIG. 5 is substantially smaller than in conventional door structures having a rigid door body and sealing membrane. It will be proved that the width of the gap adjusted according to this invention can be continuously kept below 5 mm, that means that only the differences of $\pm 5$ mm remain to be compensated above the sealing membrane.

In the coke oven door structure according to this invention, it is thus possible to use for the sealing membrane sheet metal whose thickness exceeds conventional 1.5 mm so as to provide sufficient resistance against the effects of mechanical cleaning tools and which are suitable for withstanding the impact of high pressure cleaning.

Due to the fact that the adjustment of the deformed door body to the chamber door frame is carried out mainly by locking forces of the head rails and contact forces of the sealing strips, the locking forces are also effective as contact forming forces and it is prevented that a part of the locking forces is transmitted via a limit stopper ST into the frame.

A further advantage of this invention is the fact that deformative changes of the chamber door frame which are unavoidable during longer operational time, can be easily neutralized by the door structure of this invention by keeping the resulting gap even in this case below 5 mm. Consequently, the normally necessary adjustment and calibration work on compression elements as well as on the sealing membrane itself can be dispensed with.

It will be understood that each of the elements described above, or two or more together, may also find a useful application in other types of constructions differing from the types described above.

While the invention has been illustrated and described as embodied in a specific example of a door structure for coke ovens, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A coke oven door structure for use in coke ovens, comprising a door frame secured to the oven, a movable door body of a material having a continuous high elasticity of flexure and being exposable to temperature gradients of about 100 degrees Kelvin per meter, a sealing membrane arranged at the periphery of the door body and defining a sealing strip for contacting the door frame with a specific compression force q, and at least two head rails for applying locking force on the door body, the ratio of rigidity ($E \times I$) of the door body to the specific compression force q applied through the sealing strip of the membrane being such as to compensate thermal deformations of the door body predominantly by the locking force of the head rails and by the compression force q applied to the sealing membrane, whereby E is the elasticity module of the material of the door body, I is moment of intertia of the door body, and wherein the ratio ExI/q is equal to or less than the expression $$\frac{E \cdot I}{q} \leqq \frac{\alpha \cdot H^2 \left(2 + \frac{2 \cdot B}{L}\right)}{2.06 \cdot 10^{-7} mm^{-1}}$$

where $$\alpha = \frac{5}{384} \cdot \frac{1 - 4.8 \cdot \frac{f^2}{H^2}}{1 + 2 \cdot \frac{f}{H}}$$

and wherein q is the the compression force between the sealing strip of the membrane and the door frame per length unit, H is the distance between the upper and lower head rails, f is the distance between the upper or lower head rail and the upper or lower end of the door, L is the total length of the door and B is the length of the sealing strip of the membrane over the door width.

2. A door structure as defined in claim 1, further comprising a sharp head rail arranged at the center of the door body.

* * * * *